US008452214B2

(12) United States Patent
Hobo

(10) Patent No.: US 8,452,214 B2
(45) Date of Patent: May 28, 2013

(54) DEVELOPING APPARATUS AND IMAGE FORMING APPARATUS

(75) Inventor: Jumpei Hobo, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 200 days.

(21) Appl. No.: 13/027,325

(22) Filed: Feb. 15, 2011

(65) Prior Publication Data

US 2011/0206418 A1 Aug. 25, 2011

(30) Foreign Application Priority Data

Feb. 25, 2010 (JP) ..... 2010-040867

(51) Int. Cl.
*G03G 15/10* (2006.01)

(52) U.S. Cl.
USPC ..... 399/238; 399/57; 399/348

(58) Field of Classification Search
USPC ..... 399/57, 238, 348
See application file for complete search history.

(56) References Cited

U.S. PATENT DOCUMENTS

| | | | | |
|---|---|---|---|---|
| 4,640,605 | A * | 2/1987 | Ariyama et al. | 399/225 |
| 5,561,264 | A | 10/1996 | Iino et al. | |
| 5,623,715 | A * | 4/1997 | Clark | 399/57 |
| 2006/0078343 | A1 * | 4/2006 | Shin et al. | 399/57 |

FOREIGN PATENT DOCUMENTS

| | | |
|---|---|---|
| JP | 7-219355 | 8/1995 |
| JP | 8110741 | 4/1996 |
| JP | 2005242218 | 9/2005 |

* cited by examiner

*Primary Examiner* — Walter L Lindsay, Jr.
*Assistant Examiner* — Benjamin Schmitt
(74) *Attorney, Agent, or Firm* — Dilworth & Barrese, LLP.

(57) ABSTRACT

A developing apparatus includes: a developer accumulation portion; a developer drawing-up portion that draws up the liquid developer accumulated in the developer accumulation portion; a developing roller that supplies the liquid developer to the image supporting body in a region facing the image supporting body; a developer removing portion that is disposed to contact a predetermined position on a surface of the developing roller on a downstream side to the region facing the image supporting body in a rotational direction of the developing roller, and removes the liquid developer remaining on the surface of the developing roller; and an accumulated developer delivery portion that delivers the liquid developer accumulated in the developer accumulation portion to a predetermined region on the surface of the developing roller between the region facing the image supporting body and the predetermined position contacting the developer removing portion.

10 Claims, 4 Drawing Sheets

DEVELOPING APPARATUS AND IMAGE FORMING APPARATUS

This application is based on and claims the benefit of priority from Japanese Patent Application No. 2010-040867, filed on 25 Feb. 2010, the content of which is incorporated herein by reference.

BACKGROUND OF THE INVENTION

1. Field of the Invention

The present invention relates to a developing apparatus and an image forming apparatus including a developing apparatus.

2. Related Art

Conventional image forming apparatuses such as copy machines and printers are commonly wet type image forming apparatuses that include a photoreceptor that can support a toner image and a developing apparatus that can supply liquid developer to the photoreceptor.

As the developing apparatus configuring a wet type image forming apparatus, there is a developing apparatus including: a drawing-up unit composed of a drawing-up roller that draws up liquid developer stored in a liquid developer storage unit and a developer supply roller disposed to face the drawing-up roller and on which a developer film is formed on a surface thereof; and a developing roller that supports the developer film transferred from the surface of the developer supply roller on a surface thereof.

With the developing apparatus thus configured, the liquid developer stored in the liquid developer storage unit is supplied to an image supporting body such as a photoreceptor drum via the drawing-up unit and the developing roller.

However, in the abovementioned developing apparatus of the related art, a sensor and the like for detecting an amount of the liquid developer is required for maintaining the accumulated amount of liquid developer constant in the liquid developer storage unit.

In addition, the liquid developer not supplied to the image supporting body such as the photoreceptor and remaining on the developing roller has an increased concentration of toner and increased viscosity, and is thus difficult to remove with a blade member and the like.

SUMMARY OF THE INVENTION

Consequently, an object of the present invention is to provide a developing apparatus that maintains the amount of liquid developer stored in a liquid developer storage unit constant and allows for easier removal of the liquid developer not supplied to the image supporting body and remaining on the developing roller. Another object of the present invention is to provide an image forming apparatus including the abovementioned developing apparatus.

In an aspect of the present invention, a developing apparatus that supplies liquid developer to an image supporting body includes: a developer supply portion that supplies the liquid developer; a developer accumulation portion that accumulates the liquid developer supplied by the developer supply portion; a developer drawing-up portion that drows up the liquid developer accumulated in the developer accumulation portion; a developing roller that is disposed rotatably about a rotational axis and to face the image supporting body, to which the liquid developer drawn up by the developer drawing-up portion is supplied, and that supplies the liquid developer to the image supporting body in a region facing the image supporting body; a developer removing portion that is disposed to contact a predetermined position on a surface of the developing roller on a downstream side to the region facing the image supporting body in a rotational direction of the developing roller, and removes the liquid developer remaining on the surface of the developing roller; and an accumulated developer delivery portion that delivers the liquid developer accumulated in the developer accumulation portion to a predetermined region on the surface of the developing roller between the region facing the image supporting body and the predetermined position contacting the developer removing portion.

In another aspect of the present invention, an image forming apparatus includes: an image forming portion including: an image supporting body that can support a toner image on a surface thereof; and a developing apparatus that supplies liquid developer to an image supporting body, having: a developer supply portion that supplies the liquid developer, a developer accumulation portion that accumulates the liquid developer supplied by the developer supply portion, a developer drawing-up portion that draws up the liquid developer accumulated in the developer accumulation portion, a developing roller that is disposed rotatably about a rotational axis and to face the image supporting body, to which the liquid developer drawn up by the developer drawing-up portion is supplied, and that supplies the liquid developer to the image supporting body in a region facing the image supporting body, a developer removing portion that is disposed to contact a predetermined position on a surface of the developing roller on a downstream side to the region facing the image supporting body in a rotational direction of the developing roller, and removes the liquid developer remaining on a surface of the developing roller, and an accumulated developer delivery portion that delivers the liquid developer accumulated in the developer accumulation portion to a predetermined region on the surface of the developing roller located between the region facing the image supporting body and the predetermined position contacting the developer removing portion; an input acceptance portion that accepts an image formation instruction, which is an instruction for forming a predetermined toner image on the image supporting body, and an input of image data including image information regarding the toner image, that are addressed to the image forming portion; and an image formation control portion that controls the image forming portion to form a toner image on the image supporting body, in a case of the image data being accepted by the input acceptance portion. Yet another objective of the present invention and specific advantages of the present invention will become apparent in the following descriptions.

DETAILED DESCRIPTION OF THE INVENTION

A preferred embodiment of the present invention is described hereinafter with reference to the drawings.

Figure 1:
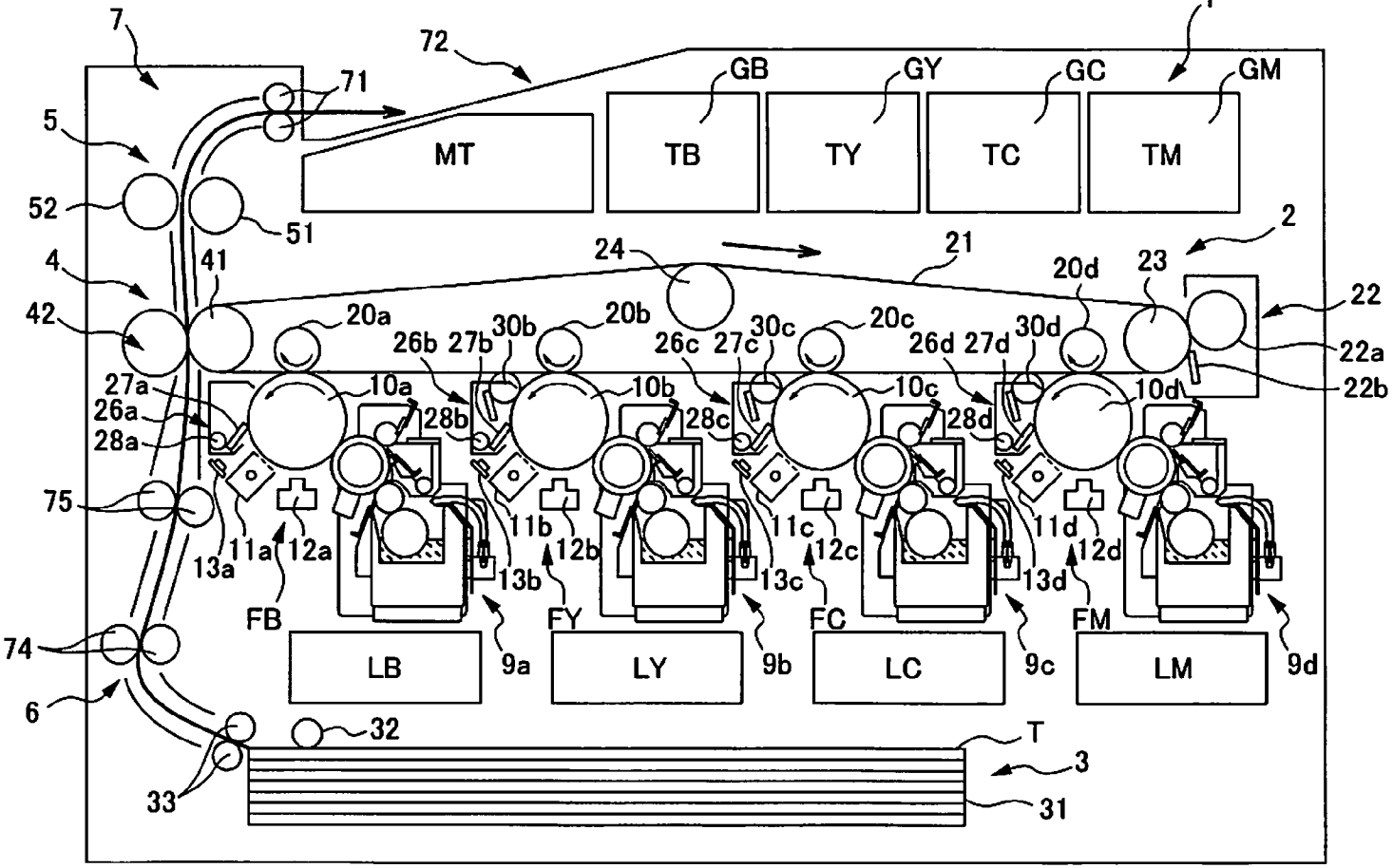
FIG. 1 is an overall view illustrating components of a color printer according to an embodiment of the present invention.

An overall configuration of a color printer 1 as an image forming apparatus is described referring to FIG. 1. FIG. 1 is an overall view illustrating components of the color printer 1 according to the embodiment of the present invention. As shown in FIG. 1, the color printer 1 includes an image forming portion 2, a paper storage portion 3, a secondary transfer portion 4, a fixing portion 5, a paper conveyance portion 6, and an ejection portion 7. The image forming portion 2 is of a tandem electrophotographic system and forms a toner image based on image data. The paper storage portion 3 stores paper T, which is an example of a transfer object. The secondary transfer portion 4 transfers the toner image formed by the image forming portion 2 onto a surface of the paper T. The fixing portion 5 fixes the toner image transferred to the paper T onto the surface thereof. The paper conveyance portion 6 conveys the paper T from the paper storage portion 3 to the ejection portion 7. The ejection portion 7 ejects (discharges) the paper T conveyed by the paper conveyance portion 6.

The image forming portion 2 includes an intermediate transfer belt 21, a cleaning portion 22, and a plurality of image forming units FB, FY, FC, and FM. The image forming portion 2 forms a toner image based on image data (an image formation instruction, image information, sheet number information and the like) input from an external device (for example, personal computer and the like) via an input acceptance portion 400 (see FIG. 3). The image data includes an image formation instruction, which is an instruction for forming a predetermined toner image on each photoreceptor drum 10*a*, 10*b*, 10*c* and 10*d* as the image supporting body (described later), image information regarding the toner image, information regarding print sheet number (the number of sheets to be dispatched to the image forming portion) and the like that are addressed to the image forming portion.

Figure 3:
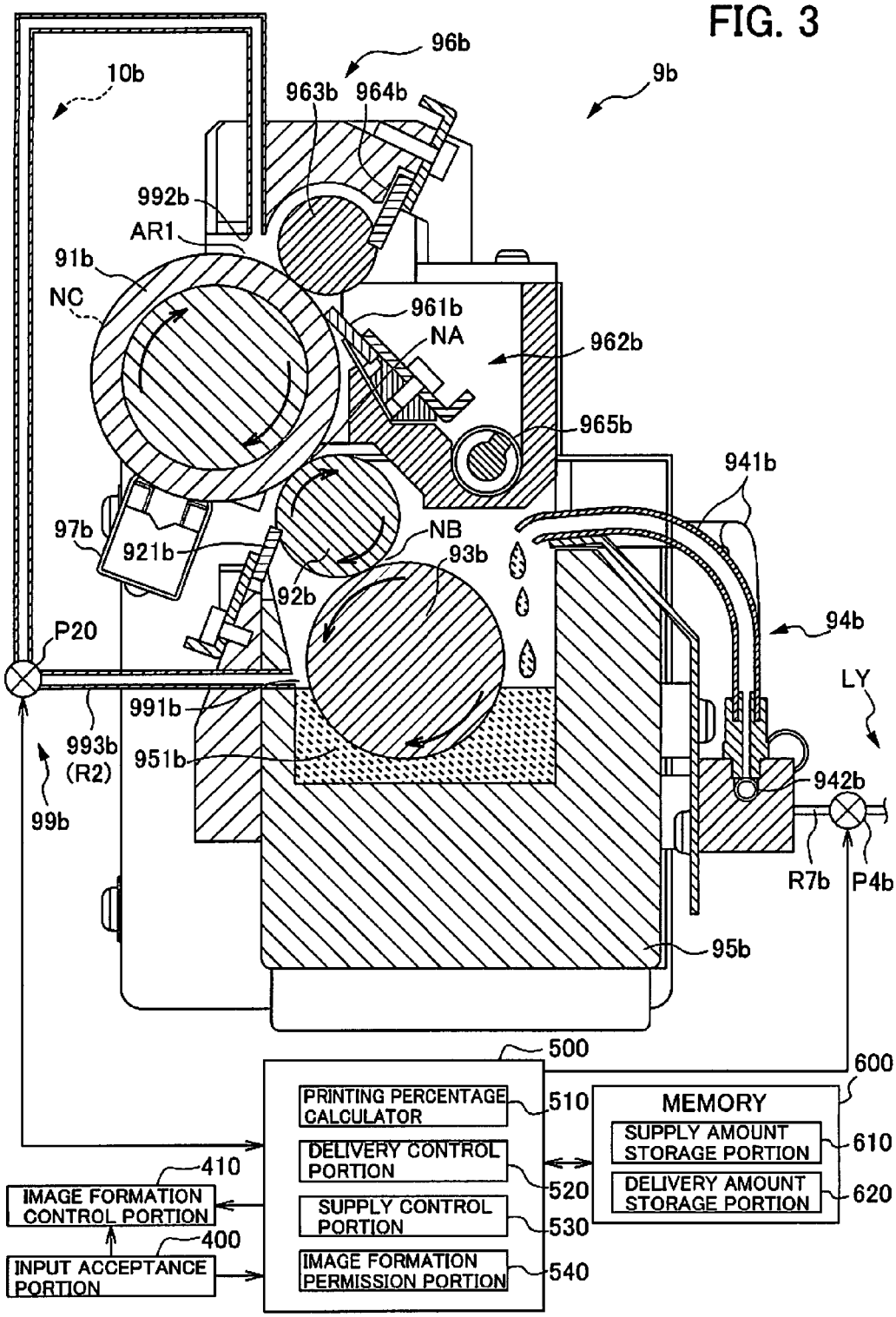
FIG. 3 is a cross-sectional view illustrating a configuration of a developing apparatus according to the embodiment of the present invention.

The image forming portion 2 is controlled by an image formation control portion 410 (see FIG. 3).

The image formation control portion 410 controls the image forming portion 2 to form the toner images on the photoreceptor drums as the image supporting body (described later).

The image formation control portion 410 controls the image forming portion 2 to form the toner images on each of the photoreceptor drums 10*a*, 10*b*, 10*c* and 10*d* as the image supporting body (described later), in a case where the image data is accepted by the input acceptance portion 400.

The intermediate transfer belt 21 is an endless belt member that is electrically conductive.

The intermediate transfer belt 21 is greater in width than the largest sheet that can be used in the color printer 1. As used herein, "width" indicates a length in a direction perpendicular to a sheet conveying direction.

The intermediate transfer belt 21 is disposed to be stretched around a drive roller 41, a driven roller 23, and a tension roller 24 that are disposed at predetermined positions, respectively.

The intermediate transfer belt 21 is circularly driven clockwise (as shown by an arrow in FIG. 1). More specifically, the intermediate transfer belt 21 is rotationally driven in the direction of the arrow (circular direction) by the drive roller 41 rotated by a rotational driving force transferred from a drive motor (not illustrated). In addition, the driven roller 23 and the tension roller 24 are driven to rotate by the intermediate transfer belt 21, which is rotationally driven. The intermediate transfer belt 21 is rotationally driven in a taut state in which the tension roller 24 is applying suitable tension so that there is no slack.

Hereinafter, a face of the intermediate transfer belt 21 directed outward is referred to as a top face and the other face is referred to as a back face.

The cleaning portion 22 includes a cleaning roller 22*a* and a cleaning blade 22*b*. The cleaning portion 22 cleans the intermediate transfer belt 21.

The image forming units FB, FY, FC, and FM are disposed in the vicinities of the intermediate transfer belt 21. The image forming units FB, FY, FC, and FM are disposed to be parallel in the horizontal direction. The image forming units FB, FY, FC, and FM are disposed parallel in the horizontal direction between the cleaning portion 22 and the secondary transfer portion 4. The image forming units FB, FY, FC, and FM are disposed in this order from the left in FIG. 1.

The image forming units FB, FY, FC, and FM are units corresponding to black (Bk), yellow (Y), cyan (C) and magenta (M), respectively.

It should be noted that, although the order of arrangement of the image forming units FB, FY, FC, and FM is not limited to the abovementioned order, the abovementioned order is preferable in consideration of the effects of color mixing on an image (image transferred onto the paper T).

In addition, toner tanks TB, TY, TC and TM respectively corresponding to the image forming units FB, FY, FC, and FM, and configuring the liquid developer circulating apparatuses LB, LY, LC and LM (described later), and a main carrier tank MT are provided. These are tanks used for the supply and collection of the liquid developer of each color. The liquid developer circulating apparatuses LB, LY, LC and LM are described later.

The image forming units FB, FY, FC, and FM are provided with photoreceptor drums 10*a*, 10*b*, 10*c* and 10*d*, charging apparatuses 11*a*, 11*b*, 11*c* and 11*d*, exposure apparatuses 12*a*, 12*b*, 12*c* and 12*d*, developing apparatuses 9*a*, 9*b*, 9*c* and 9*d*, primary transfer rollers 20*a*, 20*b*, 20*c* and 20*d*, cleaning apparatuses 26*a*, 26*b*, 26*c* and 26*d*, static eliminating apparatuses 13*a*, 13*b*, 13*c* and 13*d*, and carrier fluid removing rollers 30*b*, 30*c* and 30*d*, respectively. Here, the image forming unit FB, which is the closest to the secondary transfer portion 4 among the image forming units, has a similar configuration to other image forming units FY, FC, and FM except for not having a carrier fluid removing roller.

The photoreceptor drums 10*a*, 10*b*, 10*c* and 10*d* are cylindrical members that can support a toner image that is charged (positively in the present embodiment) on a surface thereof. The photoreceptor drums 10*a*, 10*b*, 10*c* and 10*d* are rotatably disposed counterclockwise in FIG. 1.

The charging apparatuses 11*a*, 11*b*, 11*c* and 11*d* uniformly charge the surfaces of the photoreceptor drums 10*a*, 10*b*, 10*c* and 10*d*, respectively, with a predetermined polarity and potential.

Each of the exposure apparatuses 12*a*, 12*b*, 12*c* and 12*d* has a light source portion (for example, an LED (light emitting diode) or the like), which is not illustrated. Based on the image data input from an external device (for example, PC) via the input acceptance portion (see FIG. 3), the exposure apparatuses 12*a*, 12*b*, 12*c* and 12*d* irradiate light onto the respective surfaces of the photoreceptor drums 10*a*, 10*b*, 10*c* and 10*d*, which are uniformly charged with the predetermined polarity and potential. In this way, the electric charge of exposed portions is eliminated and an electrostatic latent image is formed on the surface of each of the photoreceptor drums 10*a*, 10*b*, 10*c*, and 10*d*.

The developing apparatuses 9*a*, 9*b*, 9*c* and 9*d* support liquid developer GB, GY, GC and GM including toners and carrier fluid such that the developer is directed toward the electrostatic latent images formed on surfaces of the photoreceptor drums 10*a*, 10*b*, 10*c* and 10*d*. The developing apparatuses 9*a*, 9*b*, 9*c* and 9*d* thereby deposit toners of each color on the electrostatic latent images and develop the electrostatic latent images into toner images. The developing apparatuses are described later in detail.

The primary transfer rollers 20*a*, 20*b*, 20*c* and 20*d* are disposed on the back face of the intermediate transfer belt, corresponding to the photoreceptor drums 10*a*, 10*b*, 10*c*, and 10*d*, respectively. The primary transfer rollers 20*a*, 20*b*, 20*c* and 20*d* are disposed to face the photoreceptor drums 10*a*, 10*b*, 10*c* and 10*d*, respectively, sandwiching the intermediate transfer belt 21.

The voltage of the reverse polarity (negative polarity in the present embodiment) of the toner forming the toner image is applied to the primary transfer rollers 20*a*, 20*b*, 20*c* and 20*d* by a power source (not illustrated). In other words, the primary transfer rollers 20*a*, 20*b*, 20*c* and 20*d* apply, to the intermediate transfer belt 21, voltage of reverse polarity to the toner at the respective positions contacting the intermediate transfer belt 21. Since the intermediate transfer belt 21 is electrically conductive, the toner is drawn toward the top face of the intermediate transfer belt 21 and the vicinity thereof by this application of voltage.

The cleaning apparatuses 26*a*, 26*b*, 26*c* and 26*d* are provided with cleaning blades 27*a*, 27*b*, 27*c* and 27*d* and conveying screws 28*a*, 28*b*, 28*c* and 28*d*, respectively. The cleaning apparatuses 26*a*, 26*b*, 26*c* and 26*d* remove the liquid developer remaining on the photoreceptor drums 10*a*, 10*b*, 10*c* and 10*d* that has not been transferred to the intermediate transfer belt 21.

The cleaning blades 27*a*, 27*b*, 27*c* and 27*d* are plate-like members extending in directions of rotational axes of the photoreceptor drums 10*a*, 10*b*, 10*c* and 10*d*, respectively. The cleaning blades 27*a*, 27*b*, 27*c* and 27*d* scrape off the liquid developer remaining on the surfaces of the photoreceptor drums 10*a*, 10*b*, 10*c* and 10*d*, respectively. The cleaning blades 27*a*, 27*b*, 27*c* and 27*d* are disposed such that the tips thereof contact (slidingly contact) the surfaces of the photoreceptor drums 10*a*, 10*b*, 10*c* and 10*d*, respectively. The cleaning blades 27*a*, 27*b*, 27*c* and 27*d* scrape off the liquid developer remaining on the surfaces of the photoreceptor drums 10*a*, 10*b*, 10*c* and 10*d*, respectively, with the rotation of the photoreceptor drums 10*a*, 10*b*, 10*c* and 10*d*.

The conveying screws 28*a*, 28*b*, 28*c* and 28*d* are disposed inside the cleaning apparatuses 26*a*, 26*b*, 26*c* and 26*d*, respectively. The conveying screws 28*a*, 28*b*, 28*c* and 28*d* convey the liquid developer, which is scraped off by the cleaning blades 27*a*, 27*b*, 27*c* and 27*d* and stored inside the cleaning apparatuses 26*a*, 26*b*, 26*c* and 26*d*, to primary collection containers 81*a*, 81*b* (see FIG. 2), 81*c* and 81*d*, respectively. The conveying screws 28*a*, 28*b*, 28*c* and 28*d* also convey the carrier fluid, which is removed from the intermediate transfer belt 21 by the carrier fluid removal rollers 30*b*, 30*c* and 30*d* and stored inside the cleaning apparatuses 26*a*, 26*b*, 26*c* and 26*d*, to the primary collection containers 81*a*, 81*b* (see FIG. 2), 81*c* and 81*d*, respectively.

Each of the static eliminating apparatuses 13*a*, 13*b*, 13*c* and 13*d* has a light source (not illustrated) for eliminating static. The static eliminating apparatuses 13*a*, 13*b*, 13*c* and 13*d* eliminate static from the surfaces of the photoreceptor drums 10*a*, 10*b*, 10*c*, and 10*d*, respectively, by way of the light from the light source. The static eliminating apparatuses 13*a*, 13*b*, 13*c* and 13*d* perform a static elimination process to portions on the surfaces of the respective photoreceptor drums 10*a*, 10*b*, 10*c* and 10*d* from which the liquid developer is removed by the respective cleaning blades 27*a*, 27*b*, 27*c* and 27*d*.

The carrier fluid removal rollers 30*b*, 30*c* and 30*d* are substantially cylindrical members that are rotatably disposed about rotational axes parallel to rotational axes of the photoreceptor drums 10*b*, 10*c* and 10*d*. The carrier fluid removal rollers 30*b*, 30*c* and 30*d* remove the carrier fluid from the surface of the intermediate transfer belt 21.

The carrier fluid removal rollers 30*b*, 30*c* and 30*d* are disposed to face the surfaces of the photoreceptor drums 10*b*, 10*c* and 10*d*, respectively. The carrier fluid removal rollers 30*b*, 30*c* and 30*d* are disposed to face the photoreceptor drums 10*b*, 10*c* and 10*d*, respectively, at a position more on a downstream side in a rotational direction of the photoreceptor drums 10*b*, 10*c* and 10*d* than a position at which the photoreceptor drums 10*b*, 10*c* and 10*d* contact the intermediate transfer belt 21.

The carrier fluid removal rollers 30*b*, 30*c* and 30*d* rotate in the same direction as the photoreceptor drums 10*b*, 10*c* and 10*d*, respectively, when viewed from a predetermined direction. The carrier fluid removed by the carrier fluid removal rollers 30*b*, 30*c* and 30*d* is stored inside the cleaning apparatuses 26*a*, 26*b*, 26*c* and 26*d*.

The paper storage portion 3 is disposed in a vertically lower portion of the color printer 1. The paper storage portion 3 includes a paper feeding cassette 31 that stores the paper T, a paper feeding roller 32 that feeds the paper T to a paper conveyance portion 6 (described later), and a separation roller pair 33 that prevents a plurality of sheets of the paper T from being fed in a layered state.

The secondary transfer portion 4 includes a drive roller 41 that drives the intermediate transfer belt 21, and a secondary transfer roller 42. The secondary transfer roller 42 is disposed to be pressed toward the drive roller 41, sandwiching the intermediate transfer belt 21 therebetween. The secondary transfer portion 4 transfers the toner image formed on the intermediate transfer belt 21 (top face), to the paper T. The secondary transfer portion 4 configures, along with the above-described primary transfer rollers 20*a*, 20*b*, 20*c* and 20*d*, a transfer apparatus that transfers the toner image to the paper T.

The fixing portion 5 includes a heating roller 51 and pressurizing roller 52. The pressurizing roller 52 is disposed to face and to press the heating roller 51. The fixing portion 5 is a portion (apparatus) that fixes the toner image, which was transferred by the secondary transfer portion 4, onto the paper T. The fixing portion 5 is disposed more on a downstream side in a conveying direction of the paper T than the secondary transfer portion 4.

The paper conveyance portion 6 includes a plurality of conveyance roller pairs 74 and resist roller pairs 75. The paper conveyance portion 6 conveys the paper T fed from the paper storage portion 3 to the ejection portion 7 via the secondary transfer portion 4 and the fixing portion 5. It should be noted that FIG. 1 shows only one conveyance roller pair 74 and other conveyance roller pairs are omitted.

The ejection portion 7 includes a plurality of ejection roller pairs 71 and an ejection tray 72 disposed on a top face of the color printer 1. The ejection portion 7 is a portion from which the paper T, onto which the toner image was transferred by the secondary transfer portion 4 and fixed by the fixing portion 5 on at least one face thereof, is ejected. It should be noted that FIG. 1 shows only one ejection roller pair 71 and other ejection roller pairs are omitted.

Subsequently, the developing apparatus and the liquid developer circulating apparatus are described with reference to FIGS. 2 and 3.

Figure 2:
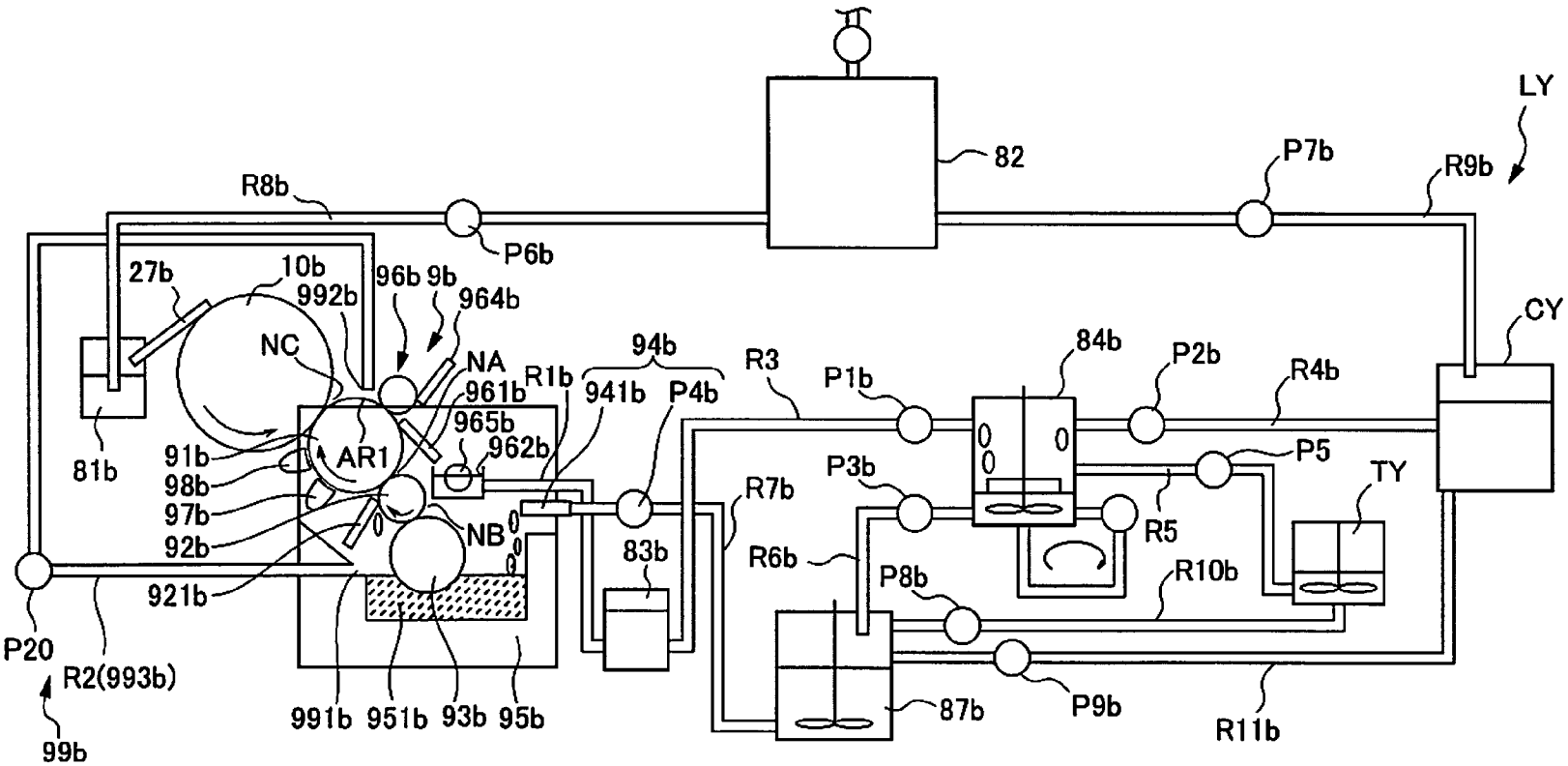
FIG. 2 is a schematic view illustrating a configuration of a liquid developer circulating apparatus according to the embodiment of the present invention.

FIG. 2 is a schematic view illustrating a configuration of the liquid developer circulating apparatus LY according to the embodiment of the present invention. FIG. 3 is a cross-sectional view illustrating a configuration of the developing apparatus 9*b* according to the embodiment of the present invention.

First, the developing apparatuses 9*a*, 9*b*, 9*c* and 9*d* are described. Herein, the developing apparatus 9*b* is described in detail and descriptions for the developing apparatuses 9*a*, 9*c* and 9*d* of a similar configuration are omitted.

As shown in FIGS. 2 and 3, the developing apparatus 9*b* includes: a developing roller 91*b;* a supply roller 92*b* and a drawing-up roller 93*b* configuring a developer drawing-up portion; a developer supply apparatus 94*b* as the developer supply portion; a developer container 95*b* as the developer accumulation portion; an accumulated developer delivery portion 99*b;* a developing roller cleaning apparatus 96*b* as the developer removing portion; and a charging apparatus 97*b*. The developing apparatus 9*b* further includes a CPU 500 and memory 600. In the present embodiment, the developing apparatus 9*b* can include the CPU 500 and the memory 600 either independently or commonly with other developing apparatuses. In addition, although the CPU 500 and the memory 600 are included in the developing apparatuses in the present embodiment, the present invention is not limited thereto and the CPU 500 and the memory 600 can be disposed in the color printer 1.

The developing apparatus 9*b* is an apparatus that supplies the liquid developer to the photoreceptor drum 10*b*.

The developing roller 91*b* is a cylindrical member disposed to face the photoreceptor drum 10*b*. The developing roller 91*b* includes an elastic portion that is disposed on an outer side thereof and constitutes a surface. The developing roller 91*b* is rotated in the direction of the arrows (clockwise) in FIG. 3.

The developing roller 91*b* is disposed to contact the photoreceptor drum 10*b* with a predetermined pressure. As a result, a contacting portion NC (facing region) is formed in a portion at which the photoreceptor drum 10*b* contacts the developing roller 91*b*.

In addition, the developing roller 91*b* is disposed to face and contact the supply roller 92*b*.

The liquid developer drawn up by the developer drawing-up portion is supplied to the developing roller 91*b*. More specifically, in the developing roller 91*b*, a developer film formed on the surface of the supply roller 92*b* is transferred to the elastic portion on the surface of the developing roller 91*b*, and the developer film thus transferred is supported on the surface of the elastic portion.

In addition, the developing roller 91*b* supplies the liquid developer to the photoreceptor drum 10*b*, in the contacting portion NC as a region facing the photoreceptor drum 10*b*.

The supply roller 92*b* configures the developer drawing-up portion.

The supply roller 92*b* is disposed to face and contact the developing roller 91*b*. The supply roller 92*b* is disposed in a lower side in a vertical direction of the developing roller 91*b*. In addition, the supply roller 92*b* is disposed such that a rotational axis thereof is horizontally offset from the rotational axis of the developing roller 91*b*. More specifically, the rotational axis of the supply roller 92*b* is offset so as not to overlap the rotational axis of the developing roller 91*b* in the vertical direction (offset to the right in FIG. 3). The supply roller 92*b* is disposed between the developing roller 91*b* and the drawing-up roller 93*b*.

The supply roller 92*b* is a roller member that supplies the liquid developer to the developing roller 91*b*.

The supply roller 92*b* has the function of a member so-called an anilox roller, and has spiral grooves on a surface thereof. The supply roller 92*b* is configured to support the liquid developer on the surface thereof by pouring the liquid developer in the spiral grooves. Herein, the liquid developer supported on the surface of the supply roller 92*b* is conveyed from a first end side (front side of FIG. 3) to a second end side (rear side of FIG. 3) in an axial direction, as the supply roller 92*b* rotates.

A supply roller blade member 921*b* is disposed in the vicinity of the supply roller 92*b* such that a tip thereof contacts the surface of the supply roller 92*b*. The supply roller blade member 921*b* restricts the thickness of a layer of the liquid developer on the supply roller 92*b*.

The supply roller 92*b* is rotated in the direction of the arrows (clockwise) in FIG. 3. In other words, in a nip portion NA in which the developing roller 91*b* contacts the supply roller 92*b*, the surface of the developing roller 91*b* moves in an opposite direction to the surface of the supply roller 92*b*. The liquid developer supported on the surface of the supply roller 92*b* is thereby transferred to the surface of the developing roller 91*b*.

The drawing-up roller 93*b* is disposed in a state in which a lower portion thereof is dipped in the liquid developer GB accumulated in the developer container 95*b*. The drawing-up roller 93*b* is disposed to face and contact the supply roller 92*b*. The drawing-up roller 93*b* is a member that is smaller in length than the supply roller 92*b* in an axial direction. The drawing-up roller 93*b* is disposed on a first end side (front side of FIG. 3) in the axial direction. The drawing-up roller 93*b* is disposed in a lower side in a vertical direction of the supply roller 92*b*. In addition, the drawing-up roller 93*b* is disposed such that a rotational axis thereof is horizontally offset from the rotational axis of the supply roller 92*b*. More specifically, the rotational axis of the drawing-up roller 93*b* is offset so as not to overlap the rotational axis of the supply roller 92*b* in the vertical direction (offset to the right in FIG. 3).

The drawing-up roller 93*b* is rotated in the direction of the arrows (counter-clockwise) in FIG. 3. In other words, in a nip portion NB at which the supply roller 92*b* contacts the drawing-up roller 93*b*, the surface of the supply roller 92*b* moves in the same direction as the surface of the drawing-up roller 93*b*. In this way, the liquid developer accumulated in the nip portion NB can be easily supplied to the supply roller 92*b* (a developer film can be easily formed on the surface of the supply roller 92*b*).

The drawing-up roller 93*b* can support the liquid developer in the vicinity of the nip portion NB contacting the supply roller 92*b*. By disposing the drawing-up roller 93*b* such that the rotational axis thereof is horizontally offset from the rotational axis of the supply roller 92*b*, the liquid developer can be accumulated more easily in the vicinity of the nip portion NB.

The developer supply apparatus 94*b* is an apparatus that supplies the concentration-controlled liquid developer to the developer container 95*b*.

The developer supply apparatus 94*b* includes: a plurality of developer supply nozzles 941*b* disposed at regular intervals in the axial direction of the supply roller 92*b;* and a pump P4*b* (described later).

The developer supply nozzles 941*b* are connected to the reserve tank 87*b* of the liquid developer circulating apparatus LY via a flow path R7*b*, and receive the liquid developer supplied from the reserve tank 87*b* (see FIG. 2). The developer supply nozzles 941*b* supply the liquid developer to the developer container 95*b*. The amount of the liquid developer supplied by the developer supply nozzles 941*b* is adjusted by way of the pump P4*b*. The pump P4*b* is controlled by a supply control portion 530 (described later).

The liquid developer supplied from the developer supply apparatus 94*b* is accumulated in an accumulation portion 951*b* of the developer container 95*b*. The liquid developer accumulated in the accumulation portion 951*b* of the developer container 95*b* is drawn up by the drawing-up roller 93*b* and transferred to the surface of the supply roller 92*b*.

In addition, in the nip portion NA at which the developing roller 91*b* contacts the supply roller 92*b*, the surface of the developing roller 91*b* moves in an opposite direction to the surface of the supply roller 92*b*. The liquid developer (the developer film) transferred to and supported on the surface of the supply roller 92*b* is thereby transferred to the surface of the developing roller 91*b*. Here, since the thickness of a developer film on the supply roller 92*b* is restricted to a predetermined range by the supply roller blade member 921*b*, the thickness of a developer film formed on the surface of the developing roller 91*b* is also maintained within a predetermined range.

The developer container 95*b* supports the drawing-up roller 93*b*, the supply roller 92*b*, the developer supply apparatus 94*b*, the developing roller 91*b*, the developing roller cleaning apparatus 96*b*, the charging apparatus 97*b*, and the supply roller blade member 921*b*, and includes the accumulation portion 951*b* that can store the liquid developer thereinside.

The developer container 95*b* stores the liquid developer supplied by the developer supply apparatus 94*b*. More specifically, the accumulation portion 951*b* of the developer container 95*b* stores the liquid developer supplied by the developer supply apparatus 94*b*.

An opening 991*b* configuring an accumulated developer delivery portion 99*b* (described later) is formed in a side face of the accumulation portion 951 of the developer container 95*b*.

The accumulated developer delivery portion 99*b* includes: a delivery pipe 993*b* (flow path R2) as the liquid delivery path disposed so as to connect the opening 991*b* disposed at a predetermined position in the accumulation portion 951*b* of the developer container 95*b* with a supply port 992*b* disposed in the vicinity of the region AR1 on the developing roller 91*b*; and a pump P20*b* that suctions the liquid developer from the opening 991*b* and delivers the liquid developer thus suctioned to the supply portion 992*b*.

As described above, the opening 991*b* is formed in the side face of the accumulation portion 951*b* of the developer container 95*b*. The opening 991*b* is formed at a position of a predetermined height from a bottom face of the accumulation portion 951*b*.

The height of the opening 991*b* from the bottom face is set such that the liquid developer can be contained in the accumulation portion 951*b* in an amount that allows for superior drawing-up properties of the drawing-up roller 93*b*. In other words, the opening 991*b* is formed at a position corresponding to a liquid surface of the liquid developer in a state of being contained in an amount that allows for superior drawing-up properties of the drawing-up roller 93*b*.

The opening 991*b* can maintain the liquid developer stored in the accumulation portion 951*b* in a predetermined amount (maintain a liquid surface at a predetermined position).

The delivery pipe 993*b* is disposed to connect the opening 991*b* with the supply port 992*b* disposed in the vicinity of the region AR1 on the developing roller 91*b*. The delivery pipe 993*b* delivers the liquid developer accumulated in the accumulation portion 951*b* of the developer container 95*b* from the opening 991*b* to the supply port 992*b*.

The supply port 992*b* is disposed in the region AR1, which is a region located between the contacting portion NC (facing region) and a region in contact with a developer collection roller 963*b* of the developing roller cleaning apparatus 96*b*, on a surface of the developing roller 91*b*.

In other words, the delivery pipe 993*b* supplies (delivers) the liquid developer, which has accumulated in the accumulation portion 951*b* of the developer container 95*b*, to the region AR1, which is a region located between the contacting portion NC (facing region) and the region in contact with the developer collection roller 963*b* of the developing roller cleaning apparatus 96*b*, on a surface of the developing roller 91*b*. The delivery pipe 993*b* is connected to the pump P20*b* as a delivery portion.

The pump P20*b* is connected to the delivery pipe 993*b*. The pump P20*b* delivers the liquid developer accumulated in the accumulation portion 951*b* of the developer container 95*b* from the opening 991*b* to the supply port 992*b* via the delivery pipe 993*b*. The pump P20*b* suctions the liquid developer from the opening 991*b* and delivers the liquid developer thus suctioned to the supply port 992*b*. In other words, the pump P20*b* suctions the liquid developer from the opening 991*b* and supplies the liquid developer thus suctioned to the region AR1 via the supply port 992*b*.

The pump P20*b* is controlled by a delivery control portion 520 (described later).

The developing roller cleaning apparatus 96*b* includes the developer collection roller 963*b*, a collection roller scraping blade 964*b*, a scraping blade 961*b*, a developer collection portion 962*b*, and an ejecting member 965*b*. The developing roller cleaning apparatus 96*b* is disposed in a state of being supported by the developer container 95*b*.

The developing roller cleaning apparatus 96*b* (the developer collection roller 963*b* and the scraping blade 961*b*) is disposed to contact a position, which is more on a downstream side than the contacting portion NC in the rotational direction of the developing roller 91 (arrow direction), on a surface of the developing roller 91*b*.

The developing roller cleaning apparatus 96*b* removes (cleans) the liquid developer that was not supplied to the photoreceptor drum 10*b* and remains on the surface of the developing roller 91*b*.

The developer collection roller 963*b* is disposed to face and contact the developing roller 91*b*. The developer collection roller 963*b* is disposed to contact a position, which is more on a downstream side than the contacting portion NC in the rotational direction of the developing roller 91 (arrow direction), on a surface of the developing roller 91*b*. The developer collection roller 963*b* is a member for collecting the liquid developer remaining on the developing roller 91*b*. The developer collection roller 963*b* is a member for collecting the liquid developer remaining on the developing roller 91*b* that was not transferred to the photoreceptor drum 10*b* in the contacting portion NC.

The collection roller scraping blade 964*b* is a member for scraping the liquid developer attached to the developer collection roller 963*b* and is disposed in a state in which a tip thereof contacts the developer collection roller 963*b*.

The scraping blade 961*b* is a plate-like member disposed to face a predetermined position on the developing roller 91*b* that is more on a downstream side in the rotational direction thereof than the developer collection roller 963*b*. The scraping blade 961*b* is disposed to contact a position, which is more on a downstream side than the contacting portion NC in the rotational direction of the developing roller 91*b* (arrow direction), on a surface of the developing roller 91*b*. The scraping blade 961*b* is disposed such that a tip thereof contacts the developing roller 91*b*. The scraping blade 961*b* is a member for scraping the liquid developer on the surface of the developing roller 91*b*. The scraping blade 961*b* is a member for scraping the liquid developer remaining on the developing roller 91*b* and not collected by the developer collection roller 963*b* that was not transferred to the photoreceptor drum 10*b* in the contacting portion NC.

The developer collection portion 962*b* has an internal space for collecting the liquid developer scraped by the scraping blade 961*b*. The internal space of the developer collection portion 962*b* is connected to a second collection container 83*b* via a flow path Rib (see FIG. 2).

The ejecting member 965*b* is a screw-like member for conveying the liquid developer collected by the developer collection portion 962*b* toward the flow path Rib connected to the second collection container 83*b* (see FIG. 2).

The charging apparatus 97*b* is disposed in the vicinity of the developing roller 91*b*. The charging apparatus 97*b* is disposed to face the developing roller 91*b*. The charging apparatus 97*b* is disposed to face a portion that is more on an upstream side than the contacting portion NC between the developing roller 91*b* and the photoreceptor drum 10*b*, and more on a downstream side than the nip portion NA between the developing roller 91*b* and the supply roller 92*b*, in the rotational direction of the developing roller 91*b*. The charging apparatus 97*b* is disposed to face a portion on the developing roller 91*b* that is between the nip portion NA and the contacting portion NC in the rotational direction of the developing roller 91*b*.

The charging apparatus 97*b* applies an electric charge (applies voltage) to the liquid developer constituting the developer film formed on the surface of the developing roller 91*b*. The charging apparatus 97*b* applies an electric charge to the liquid developer constituting the developer film by corona discharge, for example. The charging apparatus 97*b* can improve developing efficiency of the developing apparatus 9*b*.

The CPU 500 includes a printing percentage calculator 510, a delivery control portion 520 as the accumulated developer delivery control portion, the supply control portion 530, and an image formation permission portion 540.

The printing percentage calculator 510 calculates a printing percentage of the toner image formed on the photoreceptor drum 10*b*. More specifically, the printing percentage calculator 510 calculates the printing percentage based on the image information included in the image data accepted by the input acceptance portion 400. The printing percentage represents an area of the toner image (which is not limited to letters) per unit area. In other words, the printing percentage is occupancy of the toner image per unit area.

Information relating to the printing percentage calculated by the printing percentage calculator 510 is output to the supply control portion 530 (described later).

The delivery control portion 520 controls the pump P20*b*. The delivery control portion 520 controls the pump P20*b* to operate continuously or intermittently.

The delivery control portion 520 controls the pump P20*b* so as to adjust the delivery amount. The delivery control portion 520 controls the pump P20*b* so as to adjust the delivery amount in accordance with a change in the supply amount (delivery amount) of the pump P4*b*. In particular, the delivery control portion 520 controls the pump P20*b* to change the delivery amount to an amount appropriate for the supply amount of the pump P4*b* stored in a delivery amount storage portion 620 (described later), in a case where the supply amount in the pump P4*b* has changed. More specifically, the delivery control portion 520 controls the pump P20*b* to increase the delivery amount (for example, from a first delivery amount to a second delivery amount that is larger than the first delivery amount), in a case where the supply amount of the pump P4*b* changes to a third supply amount (described later) (in a case where the printing percentage is lower than a predetermined value).

The supply control portion 530 controls the pump P4*b*. The supply control portion 530 controls the pump P4*b* to change the supply amount of the liquid developer from a first supply amount to a second supply amount that is larger than the first supply amount, in a case where a toner image is formed on the photoreceptor drum 10*b* (in a case where an electrostatic latent image is formed). More specifically, the supply control portion 530 controls the pump P4*b* to change the supply amount of the liquid developer from the first supply amount to the second supply amount that is larger than the first supply amount, in a case where the image formation control portion 410 controls the image forming portion 2 to form a toner image on the photoreceptor drum 10*b*. In particular, the supply control portion 530 changes the supply amount of the liquid developer (from the first supply amount to the second supply amount) by referring to a supply amount storage portion 610 (described later), in a case where the image formation control portion 410 controls the image forming portion 2 to form a toner image on the photoreceptor drum 10*b*. In addition, the supply control portion 530 controls the pump P4*b* such that the supply amount of the liquid developer to the developer container 95*b* is larger when the image forming portion 2 is operating than when the image forming portion 2 is not operating.

Furthermore, in a case where the printing percentage calculated by the printing percentage calculator 510 is less than a predetermined value (for example, 5%), the supply control portion 530 controls the pump P4*b* to change the supply amount of the liquid developer from the first supply amount or the second supply amount to a third amount, which is larger than the second amount.

The supply control portion 530 controls the pump P4*b* such that the supply amount increases as the printing percentage calculated by the printing percentage calculator 510 decreases.

Herein, in a case where the supply control portion 530 changes the delivery amount of the pump P4*b* to the third supply amount, the delivery control portion 520 controls the pump P20*b* to increase the delivery amount. In other words, in a case where the printing percentage is low and the toner concentration and viscosity of the residual developer on the developing roller 91*b* increase, the supply control portion 530 and the delivery control portion 520 cooperatively control the pumps P4*b* and P20*b* to increase the amount of liquid developer supplied to the region AR1.

After a predetermined period of time since the supply control portion 530 changed the supply amount from the first supply amount to the second supply amount, the image formation permission portion 540 allows the image formation control portion 410 to control the image forming portion 2 to form a predetermined toner image on the photoreceptor drum 10*b* based on image data.

The memory 600 includes the supply amount storage portion 610 and the delivery amount storage portion 620.

The supply amount storage portion 610 stores the delivery amount of the pump P4*b* when the image forming portion is in a non-image forming state (the first supply amount), the delivery amount of the pump P4*b* when the image forming portion is in an image forming state and the printing percentage is greater than the predetermined value (the second supply amount) and the delivery amount of the pump P4*b* when the image forming portion 2 is in the image forming state and the printing percentage is lower than the predetermined value (the third supply amount).

The delivery amount storage portion 620 stores the delivery amount of the pump P20*b* corresponding to the supply amount of the pump P4*b*. The delivery amount storage portion 620 stores the delivery amount for the first and the second supply amounts of the pump P4*b* (the first delivery amount) and the delivery amount for the third supply amount of the pump P4*b* (the second delivery amount).

Next, the liquid developer circulating apparatus LY is described. Herein, the liquid developer circulating apparatus LY is described in detail and descriptions for the liquid developer circulating apparatuses LB, LM, and LC of a similar configuration are omitted.

As shown in FIG. 2, the liquid developer circulating apparatus LY includes a first collection container 81*b*, a separation and extraction apparatus 82, a second collection container 83*b*, an adjusting container 84*b*, a toner tank TY, a carrier tank CY, and a reserve tank 87*b*. The liquid developer circulating apparatus LY is an apparatus for reusing the liquid developer not used for image formation.

The first collection container 81*b* is a container for collecting the liquid developer remaining on the surface of the photoreceptor drum 10*b*.

The separation and extraction apparatus 82 is an apparatus for separating the liquid developer in the first collection container 81*b* into toner and carrier fluid. The separation and extraction apparatus 82 is connected to the first collection container 81*b* via a flow path R8*b*. The path R8*b* is provided with a pump P6*b*. The flow path R8*b* carries the liquid developer in the first collection container 81*b* to the separation and extraction apparatus 82.

In addition, the separation and extraction apparatus 82 is connected to the carrier tank CY via a flow path R9*b*. The flow path R9*b* is provided with a pump P7*b*. The flow path R9*b* carries the carrier fluid separated by the separation and extraction apparatus 82 to the carrier tank CY.

The second collection container 83*b* is a container for collecting the liquid developer that was not used for image formation and remains in the developing apparatus 9*b*. The second collection container 83*b* is connected to the developing roller cleaning apparatus 96*b* of the developing apparatus 9*b* via the flow path R1*b*.

The flow path R1*b* is formed to connect the developing roller cleaning apparatus 96*b* to the second collection container 83*b*. The flow path R1*b* carries the liquid developer collected by the developing roller cleaning apparatus 96*b* to the second collection container 83*b*.

Herein, as described above, the accumulated developer delivery portion 99*b* supplies the liquid developer accumulated in the accumulation portion 951 of the developer container 95*b* to the region AR1.

In other words, the flow path R1*b* carries the residual toner on the developing roller 91*b* and the liquid developer, which is supplied by the accumulated developer delivery portion 99*b* and removed (collected) by the developing roller cleaning apparatus 96*b*, to the second collection container 83*b*.

The adjusting container 84*b* is a container for adjusting the toner concentration of the liquid developer to a predetermined value. The adjusting container 84*b* is connected to the second collection container 83*b* via a flow path R3*b*. The flow path R3*b* is provided with a pump P1*b*. The flow path R3*b* carries the liquid developer in the second collection container 83*b* to the adjusting container 84*b*.

The toner tank TY stores liquid developer of a higher toner concentration than the liquid developer used in the developing apparatus 9*b*. The liquid developer of a high toner concentration is used for increasing toner concentration in the adjusting container 84*b*. The toner tank TY is connected to the adjusting container 84*b* via a flow path R5*b*. The flow path R5*b* is provided with a pump P5*b*. The flow path R5*b* carries the liquid developer of the high toner concentration stored in the toner tank TY to the adjusting container 84*b*.

The carrier tank CY stores the carrier fluid. The carrier fluid is used for lowering the toner concentration in the adjusting container 84*b*. The carrier tank CY is connected to the adjusting container 84*b* via a flow path R4*b*. The flow path R4*b* is provided with a pump P2*b*. The flow path R4*b* carries the carrier fluid to the adjusting container 84*b*. It should be noted that a carrier tank similar to the carrier tank CY is provided for each of the liquid developer circulating apparatuses LM, LC and LB (see FIG. 1). These carrier tanks receive the supply of the carrier fluid from the main carrier tank MT that is common to all colors.

The reserve tank 87*b* stores the liquid developer supplied to the developing apparatus 9*b*.

The reserve tank 87*b* is connected to the adjusting container 84*b* via a flow path R6*b*. The flow path R6*b* is provided with a pump P3*b*. The flow path R6*b* carries the liquid developer stored in the adjusting container 84*b* to the reserve tank 87*b*.

In addition, the reserve tank 87*b* is connected to the toner tank TY via a flow path R10*b*. The flow path R10*b* is provided with a pump P8*b*. The flow path R10*b* carries the liquid developer of the high toner concentration stored in the toner tank TY to the reserve tank 87*b*. By supplying the liquid developer of the high toner concentration by the flow path R10*b*, the toner concentration of the liquid developer stored in the reserve tank 87*b* can be increased small amounts at a time.

In addition, the reserve tank 87*b* is connected to the carrier tank CY via a flow path R11*b*. The flow path R11*b* is provided with a pump P9*b*. The carrier fluid stored in the carrier tank CY is carried to the reserve tank 87*b* via the flow path R11*b*. By supplying the carrier fluid by the flow path R11*b*, the toner concentration of the liquid developer stored in the reserve tank 87*b* can be lowered small amounts at a time.

In addition, the reserve tank 87*b* is connected to the developer supply nozzle 941*b* via a flow path R7*b*. The flow path R7*b* is provided with the pump P4*b*. The liquid developer stored in the reserve tank 87*b* is carried to the developer supply nozzle 941*b* via the flow path R7*b*. Thereafter, the liquid developer carried to the developer supply nozzle 941*b* is supplied to the accumulation portion 951*b* of the developer container 95*b*.

The liquid developer is accumulated in the accumulation portion 951*b* of the developer container 95*b*. The liquid developer is accumulated in a constant accumulation amount in the accumulation portion 951*b* of the developer container 95*b*.

Next, operation of the color printer 1 is described.

First, an image forming operation of the color printer 1 is described with reference to FIG. 1.

The color printer 1 accepts image data including an image formation instruction from a PC (not illustrated) connected to the color printer 1 via the input acceptance portion 400 (see FIG. 3).

The color printer 1 receives permission to start image formation from the image formation permission portion 540 (see FIG. 3) and causes the image forming portion 2 to start image formation. The color printer 1 forms a toner image of each color using the image forming units FY, FM, FC and FB based on the image information included in the image data.

More specifically, in the color printer 1, the image formation control portion 410 (see FIG. 3) permitted to start image formation by the image formation permission portion 540 controls various operating parts based on the image information included in the image data to form electrostatic latent images on the surfaces of the photoreceptor drums 1*a*, 10*b*, 10*c* and 10*d*. Thereafter, the color printer 1 operates the developing apparatuses 9*a*, 9*b*, 9*c* and 9*d* to supply toner of each color to each of the electrostatic latent images, thereby forming color toner images on the surfaces of the photoreceptor drums 10*a*, 10*b*, 10*c* and 10*d*.

The color printer 1 layers and transfers the color toner images formed by the image forming units FY, FM, FC and FB (color toner images formed on the surfaces of the photoreceptor drums 10*a*, 10*b*, 10*c* and 10*d*) onto the intermediate transfer belt 21. A full-color toner image is thereby formed on the intermediate transfer belt 21.

The color printer 1 ejects a sheet of the paper T by the paper feeding roller 32 from the paper feeding cassette 31 of the paper storage portion 3 in synchronization with formation of the full-color toner image, and then dispatches the paper T one-by-one to the paper conveyance portion 6 by the separation roller pair 33.

The conveyance roller pair 74 of the paper conveyance portion 6 conveys the paper T to the resist roller pair 75.

The resist roller pair 75 adjusts the orientation of the paper T being conveyed and suspends conveyance of the paper T. Subsequently, the resist roller pair 75 dispatches the paper T to the secondary transfer portion 4 in synchronization with primary transfer to the intermediate transfer belt 21.

The secondary transfer portion 4 secondarily transfers the full-color toner image on the intermediate transfer belt 21 to the paper T. The paper T onto which the full-color toner image has been transferred is conveyed to the fixing portion 5 by the paper conveyance portion 6.

The fixing portion 5 heats the paper T onto which the full-color toner image is transferred in a pressurized state, thereby fixing the full-color toner image onto the paper T.

The paper conveyance portion 6 conveys the paper T onto which the full-color toner image has been fixed to the ejection portion 7. Thereafter, the ejection portion 7 ejects the paper T onto which the full-color toner image is formed (fixed) to the ejection tray 72 formed on the top face of the color printer 1, by way of the ejection roller pair 71.

Next, operation of the developing apparatus 9*b* is described with reference to FIGS. 3 and 4.

Figure 4:
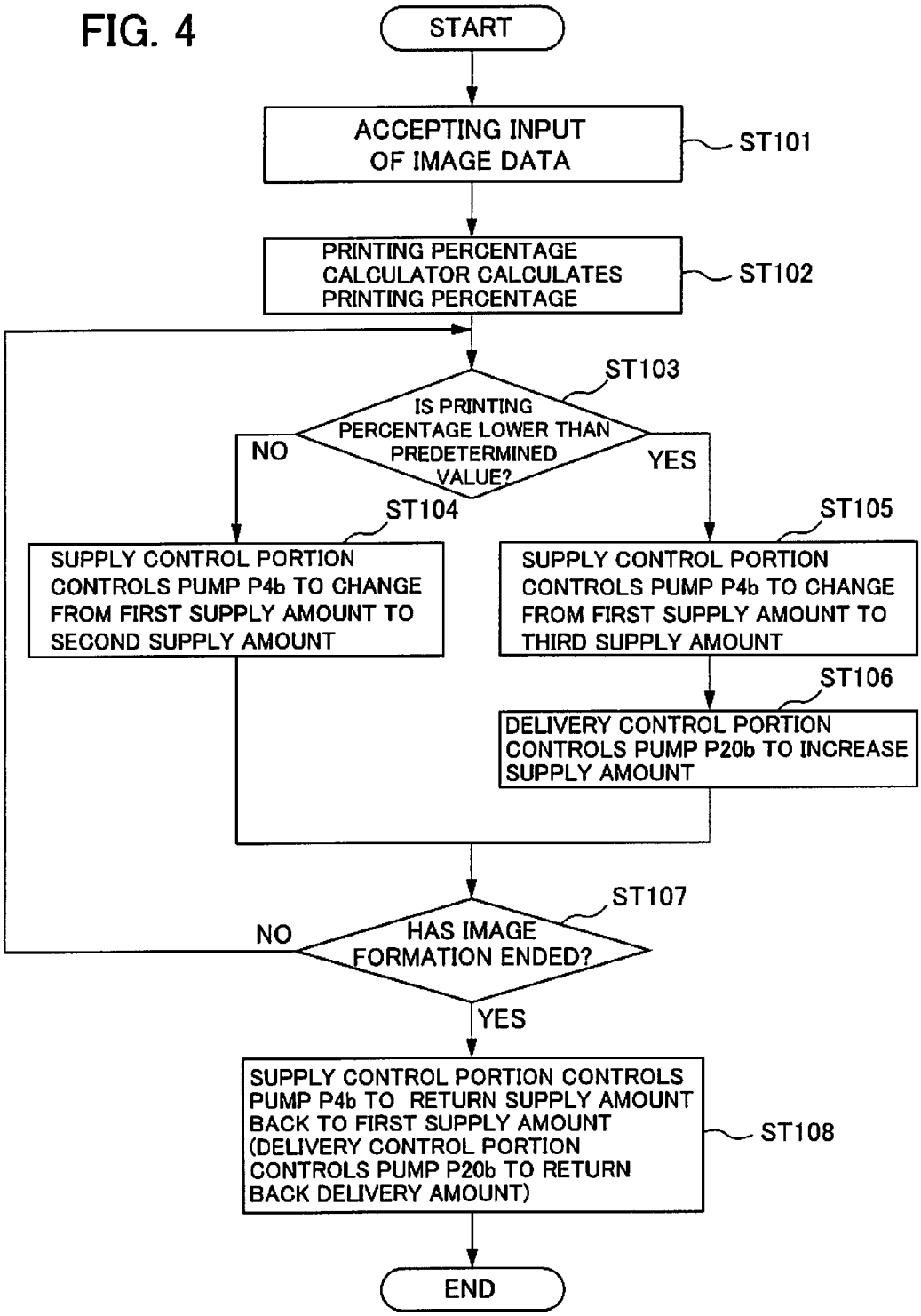
FIG. 4 is a flow chart illustrating operation of the developing apparatus according to the embodiment of the present invention.

FIG. 4 is a flow chart illustrating operations of the developing apparatus of the embodiment of the present invention.

First, in Step ST101, the input acceptance portion 400 accepts the input of image data from an external device. In response to the acceptance of the image data by the input acceptance portion 400, the image formation control portion 410 controls the image forming portion 2 to form an electrostatic latent image on the surface of the photoreceptor drum 10*b*. Herein, the supply amount of the pump P4*b* when the image forming portion 2 is in a non-image forming state is the first supply amount. In addition, the delivery amount of the pump P20*b* in this state is the first delivery amount.

Next, in Step ST102, the printing percentage calculator 510 calculates the printing percentage based on the image information included in the image data. The printing percentage calculator 510 outputs information relating to the printing percentage to the supply control portion 530.

In Step ST103, the supply control portion 530 refers to data relating to the printing percentage stored in the supply amount storage portion 610, and determines whether the printing percentage calculated by the printing percentage calculator 510 is lower than the predetermined value or not. In a case where the printing percentage is higher than the predetermined value (in a case of NO determination), the process advances to Step ST104. In a case where the printing percentage is lower than the predetermined value (in a case of YES determination), the process advances to Step ST105.

Subsequently, in Step ST104, the supply control portion 530 controls the pump P4*b* to change the supply amount of the liquid developer from the first supply amount to the second supply amount that is larger than the first supply amount. The processing then advances to Step ST107.

In Step ST105, the supply control portion 530 controls the pump P4*b* to change the supply amount of the liquid developer from the first supply amount to the third supply amount that is larger than the second supply amount. The processing then advances to Step ST106.

As described above, when the image forming portion 2 starts image formation, the supply control portion 530 controls the pump P4*b* to change the supply amount of the liquid developer from the first supply amount to the second supply amount or the third supply amount.

Next, in Step ST106, the delivery control portion 520 controls the pump P20*b* to increase the delivery amount. As a result, the supply amount is increased to the third supply amount and the delivery amount is also increased, thereby increasing the amount of the liquid developer supplied to the region AR1 of the developing roller 91*b*.

Next, in Step ST107, the supply control portion 530 refers to the image formation control portion 410 as to whether the image forming portion 2 is in operation or not.

In a case where the image forming portion 2 is determined to be in operation (in a case where the image formation continues), the processing is returned to Step ST103. In a case where the image forming portion 2 is determined not to be in operation (in a case where the image formation does not continue), the processing is advanced to Step ST108.

Next, in Step ST108, the supply control portion 530 controls the pump P4*b* to return the supply amount back to the first supply amount. In addition, the delivery control portion 520 controls the pump P20*b* to return the delivery amount back. Then, the processing ends.

According to the present embodiment, the developing apparatus can maintain the constant amount of the liquid developer accumulated in the accumulation portion of the developer container, and can also improve removal properties of the liquid developer remaining on the developing roller that was not supplied to the photoreceptor drum. The developing apparatus can thereby improve the quality of a toner image.

In addition, according to the present embodiment, the developing apparatus can maintain a constant amount of the liquid developer accumulated in the accumulation portion of the developer container, without the need of a fluid volume sensor or the like.

In addition, according to the present embodiment, the developing apparatus can maintain a constant toner concentration of the liquid developer accumulated in the accumulation portion of the developer container.

In addition, according to the present embodiment, the developing apparatus can suppress precipitation of toner particles in the liquid developer accumulated in the accumulation portion of the developer container, occurring due to prolonged accumulation.

In addition, according to the present embodiment, the developing apparatus can lower the toner concentration and viscosity of the residual liquid developer removed by the developing roller cleaning apparatus. The developing apparatus can thereby improve the removal properties of the residual liquid developer in the developing roller cleaning apparatus.

Moreover, according to the present embodiment, an image forming apparatus including the developing apparatus providing the above effects can be provided.

Although the printer 1 is exemplified as the image forming apparatus in the above embodiment, the present invention is not limited thereto. The image forming apparatus can be, for example, a color copy machine, a black and white copy machine, a black and white printer, a facsimile machine, or a multi-functional printer having these functions.

In addition, the sheet-shaped transfer object is not limited to paper, and can be a film sheet, for example.

What is claimed is:

1. A developing apparatus that supplies liquid developer to an image supporting body, the developing apparatus comprising:

a developer supply portion that supplies the liquid developer;

a developer accumulation portion that accumulates the liquid developer supplied by the developer supply portion;

a developer drawing-up portion that draws up the liquid developer accumulated in the developer accumulation portion;

a developing roller that is disposed rotatably about a rotational axis and to face the image supporting body, to which the liquid developer drawn up by the developer drawing-up portion is supplied, and that supplies the liquid developer to the image supporting body in a region facing the image supporting body;

a developer removing portion that is disposed to contact a predetermined position on a surface of the developing roller on a downstream side to the region facing the image supporting body in a rotational direction of the developing roller, and removes the liquid developer remaining on the surface of the developing roller;

an accumulated developer delivery portion that delivers the liquid developer accumulated in the developer accumulation portion to a predetermined region on the surface of the developing roller between the region facing the image supporting body and the predetermined position contacting the developer removing portion;

a supply control portion that controls the developer supply portion to change a supply amount of the liquid developer from a first supply amount to a second supply amount that is larger than the first supply amount, in a case of forming a toner image on the image supporting body; and a printing percentage calculator that calculates a printing percentage of the toner image formed on the image supporting body, wherein in a case of the printing percentage calculated by the printing percentage calculator being less than a predetermined value, the supply control portion controls the developer supply portion to change the supply amount of the liquid developer from the first supply amount or the second supply amount to a third amount, which is larger than the second amount.

2. The developing apparatus according to claim 1, wherein the accumulated developer delivery portion delivers the liquid developer so as to maintain a predetermined amount of the liquid developer accumulated in the developer accumulation portion.

3. The developing apparatus according to claim 2, wherein the accumulated developer delivery portion includes:

an opening that is disposed at a predetermined position in the developer accumulation portion;

a liquid delivery path that is disposed to connect the opening and a supply port that is disposed in the vicinity of the predetermined region; and a pump portion that suctions the liquid developer from the opening and delivers the liquid developer thus suctioned to the supply port.

4. The developing apparatus according to claim 1, wherein, in a case of the printing percentage calculated by the printing percentage calculator being less than 5%, the supply control portion controls the developer supply portion to change the supply amount of the liquid developer from the first supply amount or the second supply amount to a third amount, which is larger than the second amount.

5. The developing apparatus according to claim 1, further comprising an accumulated developer delivery control portion that controls the accumulated developer delivery portion to increase an amount of developer being delivered, in a case of the supply amount of the developer supply portion being changed to the third supply amount.

6. An image forming apparatus comprising:

an image forming portion including:

an image supporting body that can support a toner image on a surface thereof; and a developing apparatus that supplies liquid developer to an image supporting body, having:

a developer supply portion that supplies the liquid developer, a developer accumulation portion that accumulates the liquid developer supplied by the developer supply portion, a developer drawing-up portion that draws up the liquid developer accumulated in the developer accumulation portion, a developing roller that is disposed rotatably about a rotational axis and to face the image supporting body, to which the liquid developer drawn up by the developer drawing-up portion is supplied, and that supplies the liquid developer to the image supporting body in a region facing the image supporting body, a developer removing portion that is disposed to contact a predetermined position on a surface of the developing roller on a downstream side to the region facing the image supporting body in a rotational direction of the developing roller, and removes the liquid developer remaining on a surface of the developing roller, and an accumulated developer delivery portion that delivers the liquid developer accumulated in the developer accumulation portion to a predetermined region on the surface of the developing roller located between the region facing the image supporting body and the predetermined position contacting the developer removing portion;

an input acceptance portion that accepts an image formation instruction, which is an instruction for forming a predetermined toner image on the image supporting body, and an input of image data including image information regarding the toner image, that are addressed to the image forming portion;

an image formation control portion that controls the image forming portion to form a toner image on the image supporting body, in a case of the image data being accepted by the input acceptance portion;

a supply control portion that controls the developer supply portion to change a supply amount of the liquid developer from a first supply amount to a second supply amount that is larger than the first supply amount, in a case of the image formation control portion controlling the image forming portion to form a toner image on the image supporting body; and a printing percentage calculator that calculates a printing percentage based on the image information included in the image data accepted by the input acceptance portion, wherein in a case of the printing percentage calculated by the printing percentage calculator being less than a predetermined value, the supply control portion controls the developer supply portion to change the supply amount of the liquid developer from the first supply amount or the second supply amount to a third amount, which is larger than the second amount.

7. The image forming apparatus according to claim 6, wherein the accumulated developer delivery portion delivers the liquid developer so as to maintain a predetermined amount of the liquid developer accumulated in the developer accumulation portion.

8. The image forming apparatus according to claim 7, wherein the accumulated developer delivery portion includes:

an opening that is disposed at a predetermined position in the developer accumulation portion;

a liquid delivery path disposed to connect the opening portion and a supply port disposed in the vicinity of the predetermined region; and a pump portion that suctions the liquid developer from the opening and delivers the liquid developer thus suctioned to the supply port.

9. The image forming apparatus according to claim 6, wherein, in a case of the printing percentage calculated by the printing percentage calculator being less than 5%, the supply control portion controls the developer supply portion to change the supply amount of the liquid developer from the first supply amount or the second supply amount to a third amount, which is larger than the second amount.

10. The image forming apparatus according to claim 6, further comprising an accumulated developer delivery control portion that controls the accumulated developer delivery portion to increase an amount of developer being delivered, in a case of the supply amount being changed to the third supply amount in the developer supply portion.

* * * * *